US005287413A

United States Patent [19]

Ashworth

[11] Patent Number: 5,287,413

[45] Date of Patent: Feb. 15, 1994

[54] DUAL VOICE COIL SOUND REPRODUCING DEVICE

[76] Inventor: William J. Ashworth, 1012 Ashworth Cove, Altamonte Springs, Fla. 32714

[21] Appl. No.: 873,257

[22] Filed: Apr. 24, 1992

[51] Int. Cl.[5] ..... H04R 25/00

[52] U.S. Cl. ..... 381/194; 381/195; 381/200

[58] Field of Search ..... 381/195, 152, 200, 192, 381/194, 197, 24, 89

[56] References Cited

U.S. PATENT DOCUMENTS

| | | | |
|---|---|---|---|
| 3,178,512 | 4/1965 | Ashworth | 381/120 |
| 3,334,195 | 8/1967 | Ashworth | 381/199 |
| 3,449,531 | 6/1969 | Ashworth | 381/200 |
| 3,609,252 | 9/1971 | Broce et al. | 381/175 |
| 4,151,379 | 4/1979 | Ashworth | 381/200 |
| 5,058,173 | 10/1991 | Ashworth | 381/152 |

FOREIGN PATENT DOCUMENTS

| | | | |
|---|---|---|---|
| 0968234 | 11/1950 | France | 381/195 |
| 2029669 | 3/1980 | United Kingdom | 381/195 |

*Primary Examiner*—Forester W. Isen
*Assistant Examiner*—Huyen D. Le

[57] ABSTRACT

A magnetic audio transducer where both channels of a stereo sound system are fed into a single sound reproducing device having two separate voice coils wound on a single magnetizable core with each voice coil receiving a separate electrical sound signal.

2 Claims, 1 Drawing Sheet

DUAL VOICE COIL SOUND REPRODUCING DEVICE

BACKGROUND OF THE INVENTION

The present invention relates to audio transducers and more particular to a method of combining two separate audio signals of a stereo system in a single sound reproducing device consisting of two separate voice coils, with each voice coil being energized by separate electrical signals. Heretofore, audio transducers have been proposed, for example, my prior U.S. Pat. Nos. 3,178,512, 3,334,195, 3,449,531, 3,609,252, 4,151,379 and 5,058,173. All of these proposed devices were designed to operate from a single sound signal. By proposed audio transducer, U.S. Pat. No. 4,151,379 has two voice coils with one being a bass voice coil and the second one being a treble voice coil. Both of these voice coils operate from a separate sound signal. Applicant is not aware of any prior art that is in any way similar to the present invention other than proposed dual voice coils used in movable coil dynamic sound reproducing devices.

SUMMARY OF THE INVENTION

Audio transducers are well known and their operation will not be explained in this application. The present invention provides an inexpensive method to combine the two audio signals of a stereo sound system in a single sound reproducing device such as an audio transducer or loudspeaker. The primary purpose of such a device is to provide a method to substantially or totally eliminate the blank or dead sound areas in the spacing between the conventional stereo speakers. If the present invention is mounted on a vibratile surface such as a wall, ceiling, door or other vibratile object between the conventional stereo speakers, the two stereo channels will be blended together and the sound will be substantially non-directional. This non-directional radiated sound will fill in any dead space between the conventional stereo speakers.

If the vibratile surface the audio transducer is attached to is of sufficient size, the vibratile surface will produce reverberation because it will sustain the vibrations produced by the audio transducer for a period of time.

Another primary purpose that the present invention was developed for is for the use in automobiles and trucks equipped with stereo equipment. When the present invention is attached to a portion or more particular the sheet metal of the vehicle and played together with the vehicle's stereo speakers, the whole vehicle will vibrate and radiate sound enveloping the driver and passengers inside the sound cavity. The vehicle's sheet metal will produce unbelievable high quality sound. The sheet metal will also sustain the sound vibrations for a period of time to produce extremely pleasing reverberation. The audio transducer in the present disclosure is resonate at the low end at approximately 70 Hertz which will cause the car body, windshield or glass windows to produce excellent sound. The vehicle will produce good bass tones down to approximately 40 Hertz. It is necessary to balance the sound volume of the vehicle's speakers with the sound volume of the present invention as shown in the present disclosure.

For attaching the audio transducer to metal or glass, a block of wood should be cemented to the metal or glass surface and the transducer screwed into the wood block. If desirable, a hole may be drilled in the sheet metal and the transducer screwed into the hole.

DESCRIPTION OF THE PREFERRED EMBODIMENTS

Figure 1:
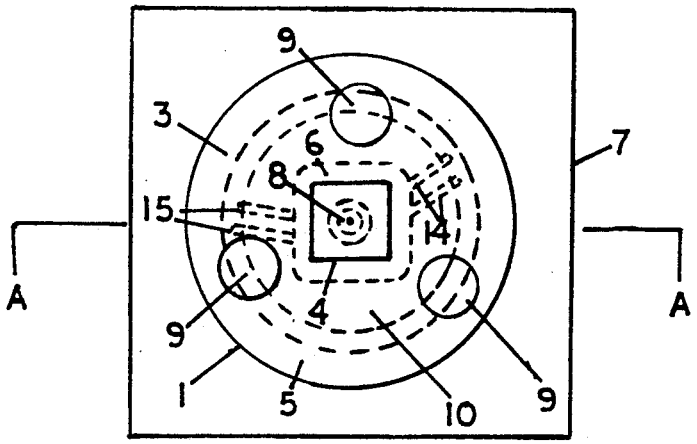
FIG. 1 is a top view of the present invention.
Figures 2, 3:
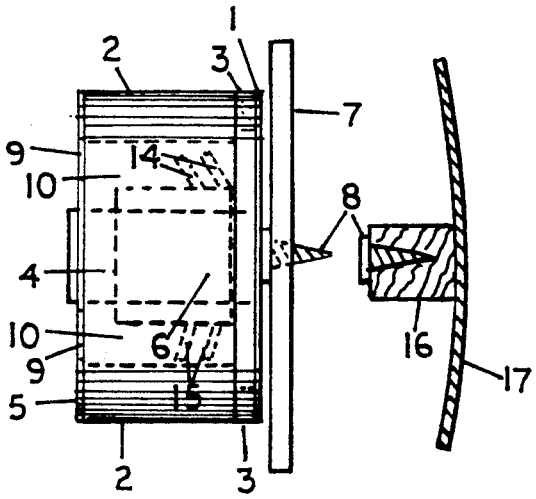
FIG. 2 is a side view of the present invention.
FIG. 3 is a sectional side view of a wood block glued to a metal or glass sounding board.
Figure 4:
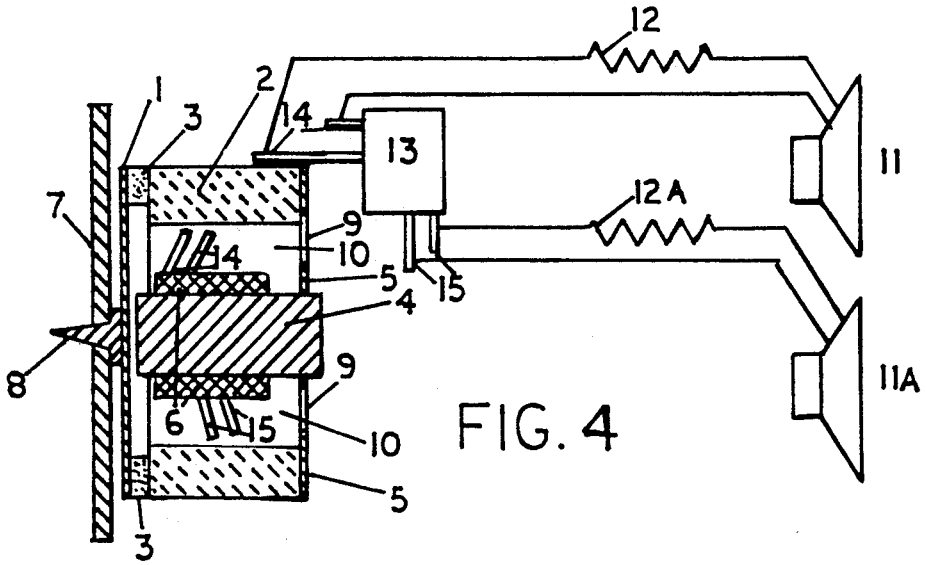
FIG. 4 is a sectional side view of the present invention together with a schematic drawing showing method of connecting a stereo conventional cone type speakers to the present invention.

A magnetically activated vibratile plate is attached to a circular permanent magnet 2 with circular pad 3 that may be constructed from foam rubber such as neoprene that is interposed between the magnet and the vibratile plate. A suitable cement such as contact cement is used to fasten pad 3 in place. Plate 1 may be constructed from 24 gauge cold rolled steel. Core 4 is attached to mounting plate 5 with a suitable cement such as epoxy. Core 4 may be constructed from laminated electrical steel or other suitable core material well known in the art. Mounting plate 5 may be constructed from 24 gauge cold rolled steel. Plate 5 is rigidly attached to magnet 2 with a suitable cement such as epoxy. Core 4 has two voice coils 6 of wire consisting of approximately 200 turns of No. 27 copper wire or other suitable size wound on it and coils 6 are energized by an external stereo electrical signals thru the dual coils leads 14–15. The entire transducer structure is attached to sounding board 7 with screw 8 or any other suitable means such as double faced adhesive tape or screwed into a wood block 16 attached to a metal or glass surface such as the sheet metal or glass of an automobile 17. Mounting plate 5 has an opening or openings 9 in it to provide an outlet for sound produced in sound chamber 10. A transducer housing, although not shown, may be used for cosmetic purposes. FIG. 4 is a schematic view of conventional loudspeakers 11—11A being used together with the present invention. Conventional dynamic speakers 11—11A may be connected in parallel with the present invention with sound volume balancing means 12—12A such as fixed or variable resistors placed in the loudspeaker 11—11A circuits to balance the sound volume between speaker 11—11A and the present invention. Both speakers 11—11A and the present invention will usually be powered by a stereo electrical signal. When a stereo electrical signal is fed simultaneously into the dual coils 6 from stereo amplifier 13, the two coils interact with each other with a transformer action setting up an opposition voltage to the incoming electrical signal. This effect increases the impedance of the dual coils 6. If the stereo electrical signal from the stereo amplifier is unbalanced, the coil receiving the lesser signal will allow the transformer action taking place between the two coils 6 to cause some short circuiting effect. If the two channel electrical signals are unbalanced as much as the stereo amplifier will allow, the impedance of the other coil 6 will be reduced. The increase and decrease of the impedance is within the operating limits of the stereo amplifier. At the lower operating frequencies the transformer action is less efficient than at the frequencies above 400 Hertz. The lower the efficiency of the transformer action between coils 6, the lower back electromotive force will be generated in the two coils. At operating frequencies between approximately 30 and 150 Hertz thru each coil, the sound volume generated will increase by approximately 4 decibels more than if only one coil is operating. If the electrical signal is disconnected from one of the dual coils, the sound volume will decrease by approximately 4 decibels. As the operating frequency is increased above approximately 150 Hertz, the transformer action between the two coils increases, developing more back electromotive force in the two coils. The increased sound volume gradually decreases with both coils operating when the input signals are increased from 150 to 2000 Hertz. Above approximately 2000 Hertz, the sound volume generated by both coils is approximately the same as if only one coil was being energized. This result is caused by a greater back electromotive force being generated in the two coils because of the greater transformer action between the two coils at the higher operating frequencies. The transformer action between the two separate coils is advantageous because the bass response is substantially increased because of the lower back electromotive force generated in the two coils at the lower frequencies than at the higher frequencies. In order to keep the transformer action between the two voice coils balanced, it is best to wind the two voice coils simultaneously on the coils' bobbin. Although one form of the present invention has been shown, it will be understood that details of the construction shown may be altered or omitted without departing from the spirit of this disclosure as defined by the following claims.

I claim:

1. A magnetic type audio transducer having two separate voice coils wound together on the same magnatizable core mounting means, wherein separate electrical signal means are supplied to each separate voice coil with said separate signals being magnetically mixed together to activate vibratile magnetizable means located in a spaced relation to said magnetizable core with said vibratile magnetizable means being attached to vibratile sounding board means, whereby said separate coils are positioned on said magnetizable core means where said coils act in electrical opposition to each other, with said electrical opposition being substantially equal in each said coil when the same electrical signal frequency is applied to each said coil and the said electrical opposition being unequal when a different electrical signal is applied to each said coil.

2. A magnetic audio transducer according to claim 1 where said audio transducer is operated in combination with other sound reproducing means.

* * * * *